United States Patent [19]

Nagai

[11] Patent Number: 4,985,001

[45] Date of Patent: Jan. 15, 1991

[54] ELECTRICAL APPLIANCE HOLDER

[75] Inventor: Toshio Nagai, Changwon, Rep. of Korea

[73] Assignee: Minami International Corp., New York, N.Y.

[21] Appl. No.: 464,994

[22] Filed: Jan. 16, 1990

[51] Int. Cl.[5] ..... H01R 13/627

[52] U.S. Cl. ..... 439/527; 439/531; 439/591

[58] Field of Search ..... 439/414, 419, , 502, 439/529, 527, 531, 541, 558

[56] References Cited

U.S. PATENT DOCUMENTS

| | | | |
|---|---|---|---|
| 2,465,700 | 3/1949 | Tuttle | 439/414 X |
| 2,657,367 | 10/1953 | Brooks | 439/414 |
| 2,869,101 | 1/1959 | Benander | 439/414 |
| 3,251,023 | 5/1906 | Suhick | 439/414 |
| 4,777,573 | 10/1988 | Liao | 439/419 X |

*Primary Examiner*—Eugene F. Desmond

*Attorney, Agent, or Firm*—Amster, Rothstein & Ebenstein

[57] ABSTRACT

An appliance holder comprises an electrically insulative housing defining a first cavity for receiving an electrical appliance and a second cavity for receiving a pair of electrical wires, and electrically conductive contacts for operatively connecting the electrical appliance and the pair of wires. The appliance holder additionally includes a generally U-shaped clip of electrically insulative resilient material. The clip defines a pair of legs and a bight connecting the legs, the bight and legs being configured and dimensioned to pass around a plurality of other electrical wires. The free ends of the legs are received within and releasably engage the housing for integrating the clip, the appliance holder, the pair of wires, the other electrical wires, and the electrical appliance for movement as a unit.

20 Claims, 3 Drawing Sheets

FIG. 2
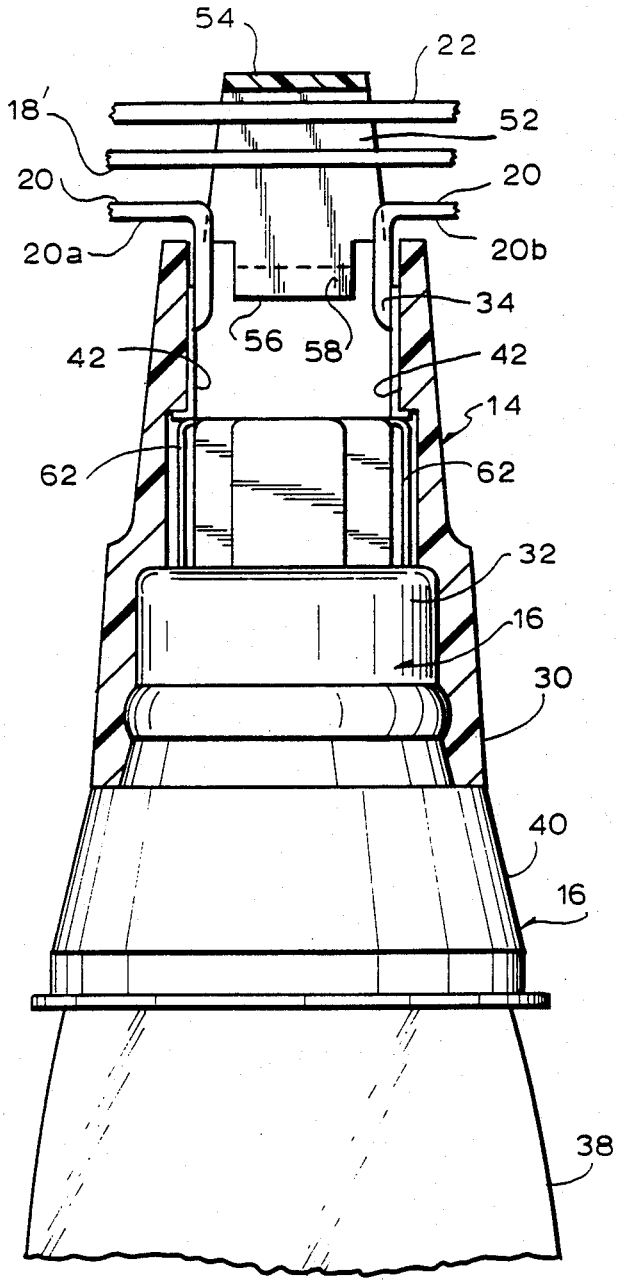
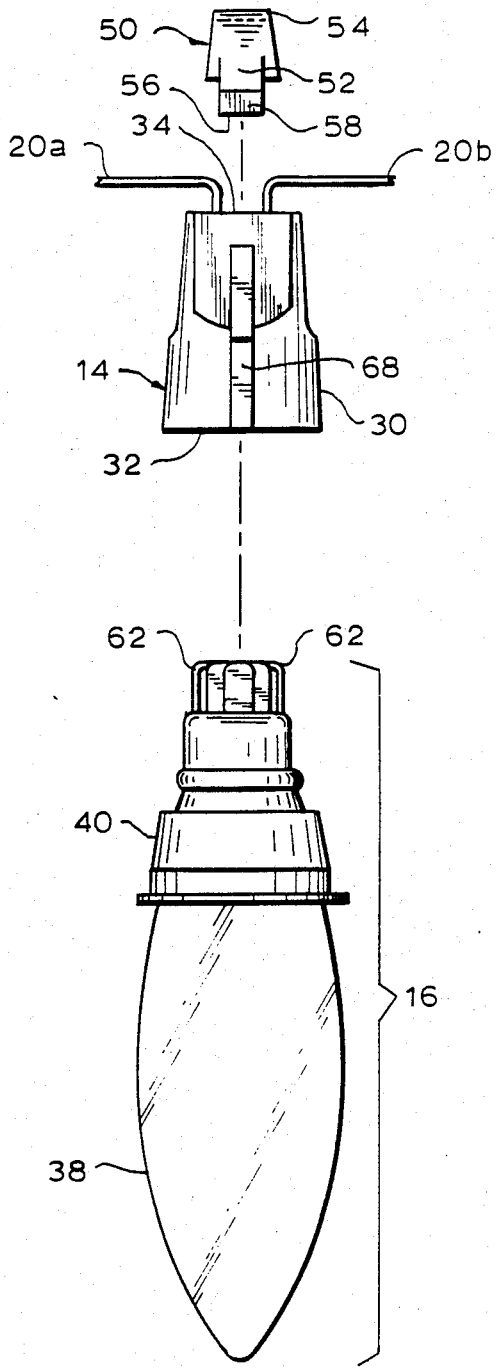
FIG. 3

FIG. 4
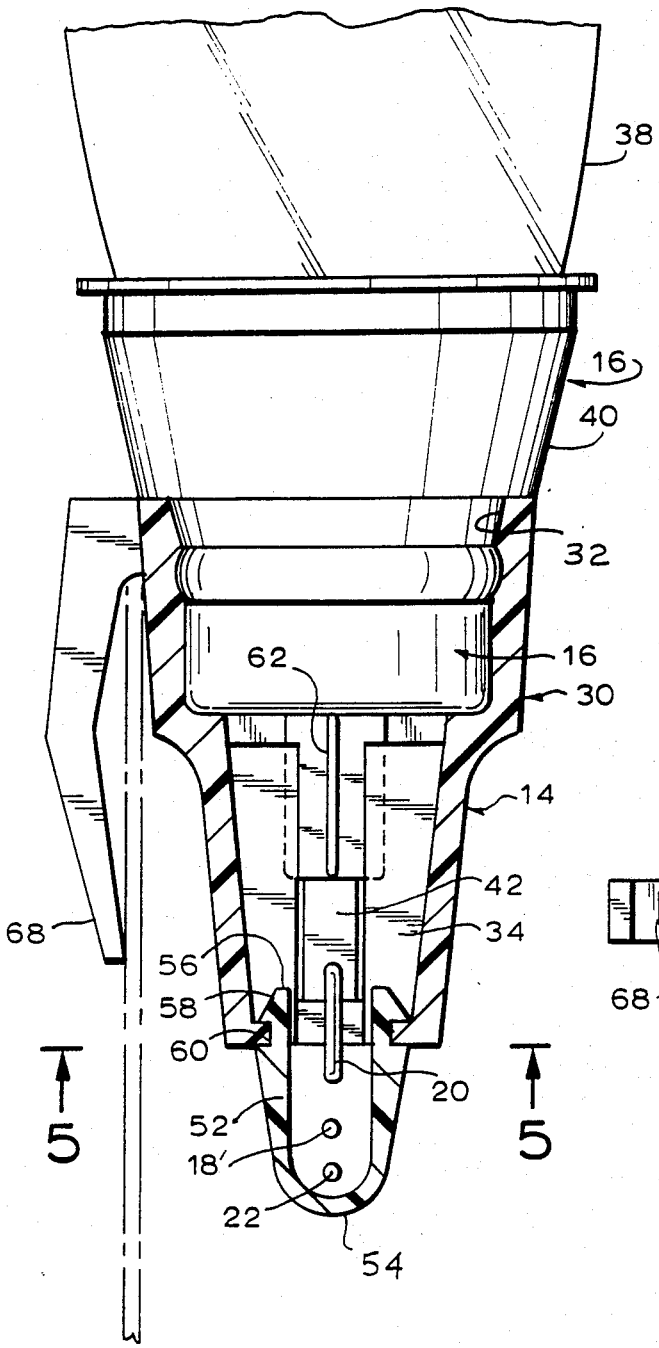
FIG. 6
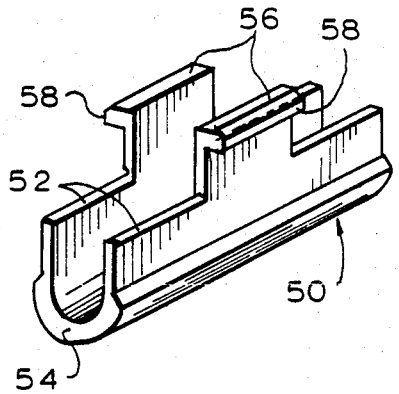
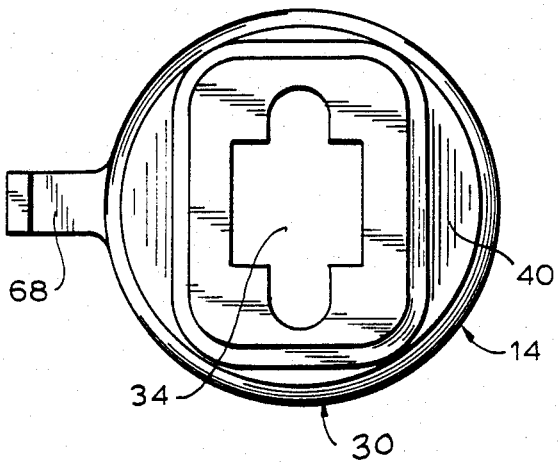
FIG. 5

ELECTRICAL APPLIANCE HOLDER

BACKGROUND OF THE INVENTION

The present invention relates to an appliance holder for receiving an electrical appliance and a pair of electrical wires to energize the electrical appliance, and more particularly to a lamp holder wherein the electrical appliance is a lamp.

In their most basic form a string of lights, of the type used to illuminate Christmas trees, windows, housing outlines and the like during Christmas and other festive occasions, comprises a plurality of lights disposed in series on a pair of electrical wires. One of the wires is the active wire, and the other is the return or ground. Because the failure of a single lamp breaks the series circuit and extinguishes all the bulbs, in an improved embodiment each lamp socket or husk is disposed in a parallel circuit with the active and ground wires of the pair. This permits other bulbs in the series circuit to remain on even though one or more of the bulbs in a parallel circuit is broken or removed. Alternatively, each bulb in the plurality of bulbs wired in series can have two filaments: an illumination filament and a continuity filament. If the illumination filament breaks or burns out, the continuity filament allows the other bulbs in the series circuit to continue to illuminate. In a complex embodiment of the light string, the bulbs are divided into various sets, with the various sets flashing alternately to produce an interesting visual impact. In this embodiment there are a plurality of active wires, one for each set of lights. The present invention is particularly useful in connection with this complex embodiment of the string light system.

The known complex string lights have not proven to be entirely satisfactory in use. As the plurality of active wires and the one or more ground wires must extend the full length of the string, means must be provided for keeping the various wires in a relatively neat aesthetic package. To this end, the various wires are often twisted together in a spiral, but the spiral often unwinds during storage or mounting or unmounting of the strings. Fastening members have also been used to mechanically couple the wires intermediate the bulb sockets thereof, in order to maintain the wires together as they travel from one socket to another. While this has worked satisfactorily for the relatively small and hence lightweight bulbs typically employed indoors as Christmas tree decorations, it has not worked as well with the larger and therefore heavier bulbs commonly used outdoors for decorating porches, outlining house roofs or the like.

The active wire for a particular bulb socket must by itself support the bulb socket and bulb depending therefrom against not only the force of gravity, but also any incident winds or debris impacting on the bulb or bulb socket. In the case of large lamps and heavy sockets especially, this can result in breakage of the wires intermediate the sockets or disconnection of the wires and the socket at their usual points of interconnection within the socket. In the less typical but still frequent situation where the socket is itself supported, if the span between that socket and the next socket of the set is large, the weight of the intervening active wire stresses and may even be sufficient to break the electrical connection between the active wire and the self-supported socket.

Accordingly, it is an object of the present invention to provide an appliance holder (such as a lamp holder) in which the holder is supported by more than just the active wire.

Another object is to provide an appliance holder which provides support for the wires extending between the holders of another set intermediate their connections to the holders of the other set.

It is a still further object of the present invention to provide a self-fastening mechanical reinforcing means which may be applied to each holder to distribute the weight of each holder among the plurality of wires at each holder including those wires which do not make electrical contact at the holder.

SUMMARY OF THE INVENTION

It has now been found that the above and related objects of the present invention are obtained in an appliance holder. In its conventional aspect, the appliance holder (e.g., a lamp holder) comprises a housing defining a first cavity for receiving an electrical appliance (e.g., a lamp), a second cavity for receiving a pair of electrical wires, and means for operatively connecting the appliance and the pair of wires. According to the present invention, a generally U-shaped clip of electrically insulative resilient material is provided. The clip defines a pair of legs and a bight connecting the legs. The bight and legs are configured and dimensioned to pass around a plurality of other electrical wires. The free ends of the legs are received within and releasably engage the housing for integrating the clip, the appliance holder, the pair of wires, the other electrical wires, and the electrical appliance for movement as a unit.

Preferably the electrical appliance comprises a lamp subassembly including a bulb and a bulb base having a pair of electrical contacts for energizing the bulb, and the contact means in the housing operatively connects the pair of electrical wires and the bulb base electrical contacts when the appliance holder receives the bulb base within the first cavity.

The appliance holder may be used in combination with a series of like appliance holders wherein one of the pair of electrical wires received in the second cavity of the appliance holder comprises one of the plurality of other electrical wires passing through the bight of one of the like appliance holders. Thus each of the other electrical wires is connected to at least one like appliance holder.

In a preferred embodiment, the pair of electrical wires and the plurality of other electrical wires in combination support the appliance holder. In another preferred embodiment, for use with a support, the housing additionally includes means for releasably securing the housing to the support, whereby, when the housing is secured to and supported by the support, it in turn supports the pair of electrical wires and the plurality of other electrical wires passing through the bight.

Preferably the first and second cavities are disposed at opposite ends of a generally cylindrical housing, but the second cavity is of non-circular cross section to preclude relative rotation of the housing and the clip when the legs are received in the second cavity. The bight biases the legs outwardly so that they are received within and releasably engage the second cavity of the housing. For example, the free end of each of the legs may define an outwardly projecting flange, and the second cavity may define a laterally opposed pair of surfaces adapted to receive the flanges when the free ends of the legs are received in the second cavity.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein:

FIG. 2 is a fragmentary front elevation view, partially in section and to an enlarged scale, of one of the lamp holders and the components associated therewith;

FIG. 3 is an exploded front elevation view of a lamp holder and the components associated therewith;

FIG. 4 is a fragmentary side elevation view, partially in section and to an enlarged scale of a lamp holder and the associated components;

FIG. 5 is a top plan view of a lamp holder with the clip removed, taken along the line 5—5 of FIG. 4; and FIG. 6 is an isometric view of a variation of a clip according to the present invention.

DETAILED DESCRIPTION OF THE PREFERRED EMBODIMENTS

Figure 1:
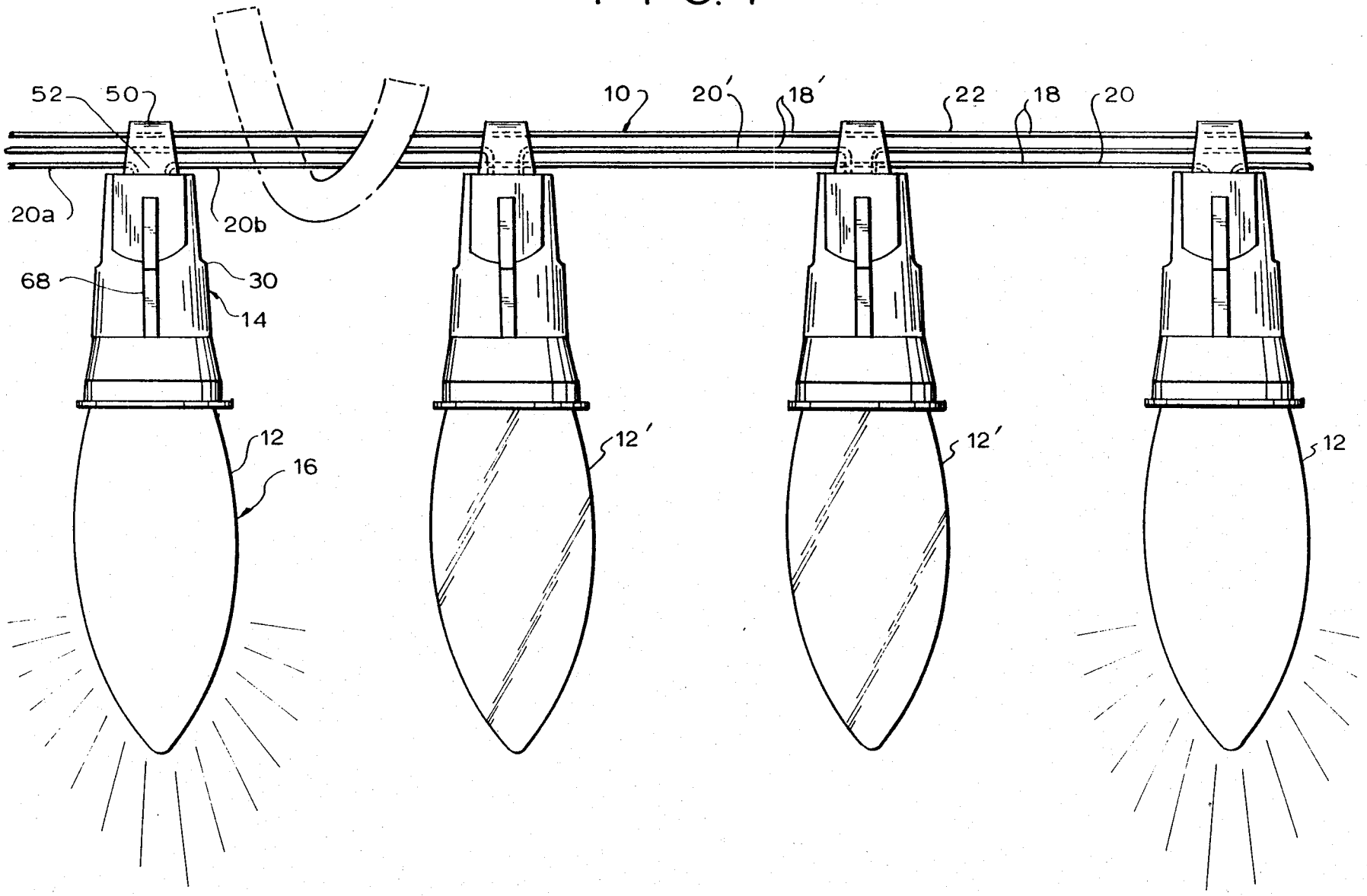
FIG. 1 is a fragmentary front elevation view of a complex string of lights with lamp holders according to the present invention.

Referring now to the drawing and in particular to FIG. 1 thereof, therein illustrated is a complex string of lights generally designated by the reference numeral 10. The string 10 is in turn composed of a plurality of sets 12, 12' of lamp holders generally designated 14 and lamps generally designated 16 (this term being used to refer to the combination of a lamp and its lamp base, if any). Each of sets 12, 12' flashes at the same time, but at a different time than the other sets 12, 12' . Of course, if desired, there may be more than two sets and two or more sets may flash at the same time, that time being the same or different from the time at which one or more other sets flash. Each set 12, 12' will include a pair of wires 18, 18' , each wire pair consisting of an active or live wire 20, 20' and a return or ground wire 22. If desired, however, the several sets 12, 12' , if wired in parallel, may utilize a common ground wire 22. It will be appreciated that, vis-a-vis a given lamp 16, one segment **20*a* of the active wire 20 serves the function of providing electrical energy (that is, truly acts as the active wire) while the other segment 20*b* of the active wire 20 acts as the return or ground wire vis-a-vis that particular lamp 16, although it may also act as the true active wire 20*a* for another lamp 16** disposed downstream in series in that set.

Referring now to FIGS. 2-5 in particular, in its conventional aspects, each lamp holder 14 comprises a housing or husk 30 made of electrically insulative material and defining a first cavity 32 and a second cavity 34. The two cavities 32, 34 are illustrated as disposed at opposite ends of the housing 30, but clearly the cavities 32, 34 may be disposed in other respective orientations to one another, for example, at right angles.

The first cavity 32 is adapted to receive the lamp 16, which may either be a bulb 38 by itself or a combination of a bulb 38 and a bulb base 40, as illustrated, to facilitate connection of the lamP 38 and the housing 30. The second cavity 34 is adapted to receive a pair of electrical wires 20, one of which serves as the truly active wire **20*a*, and the other as the ground wire 20*b* relative to the particular lamp holder 14. Electrically conductive contact means 42 are disposed within the housing 30 to operatively electrically connect the lamp 16 (and in particular the bulb 38 either directly or via the bulb base 40) to the pair of wires 20**.

As the aspects of the light string 10, sets 12, 12', and lamp holders 14 described hereinabove are conventional in nature further exposition thereof is not deemed necessary. The lamp holders may be disposed in series, series-parallel or parallel relation relative to the wire pair 18, 18'. Similarly, the lamp holder may be sized as appropriate for a particular application; for example, midget, miniature, candellabra, intermediate or medium in size. Similarly, the lamp may be of the push-in, screw-shell, skeleton or other conventional type.

In its novel aspects, the lamp holder 14 according to the present invention includes a generally U-shaped clip generally designated 50. The clip 50 is formed of mechanically resilient material and defines a pair of legs 52 and a bight 54 connecting the legs 52. The clip 50, and in particular the bight 54 and legs 52 thereof, are configured and dimensioned to pass around a plurality of other electrical wires, such as the active wires 20' of other sets 12' in the string 10 and the ground wire or wires 22 serving the various sets 12, 12' of the string 10. The free ends 56 of the legs 52 are received within and releasably engage the housing 30 so as to integrate the clip 50, the lamp holder 14 receiving the clip 50, the pair of electrical wires **20*a*, 20*b* serving that lamp holder 14 and secured thereto, the other electrical wires 20' , 22 (such as those serving the other sets 12' within the string 10) passing through the clip 50, and the lamp 16 secured to lamp holder 14**, all for movement as a unit.

The clip 50 is preferably formed of an electrically insulative material and is conveniently formed of an electrically insulative plastic or a medium hard rubber which affords the desired degree of resiliency to enable the clip 50 to be secured to the housinq 30 against accidental displacement, while enabling forced manual removal of the clip 50 from the housing 30 by intentional squeezing of the clip 50 to draw the leg free ends 56 towards each other. While the leg free ends 56 of the clip 50 may be secured to the second cavity 34 of the housing 30 of the lamp holder 14 in a variety of different ways which will be readily apparent to those skilled in mechanical arts, preferably the leg free ends 56 include outwardly extending flanges or shoulders 58 which are adapted to be received and releasably maintained by ledges, recesses or grooves 60 defined by the inner wall of the second cavity 34 under the outward biasing of the leg free ends 56 by the clip bight 54.

The bulb base 40 includes a pair of electrical contacts 62 for energizing the bulb 38, these base electrical contacts 62 being adapted for operative electrical connection with the pair of electrical wires 20 serving the lamp holder 14 via housing electrical contacts 42 when the lamp holder 14 receives the bulb base 40 within the first cavity 32 thereof.

The outer surface of housing 30 is preferably generally cylindrical in configuration, but the inner surface thereof defining the second cavity 34 is preferably of non-circular cross section to preclude relative rotatio of the housing 30 and the clip 50 when the clip legs 52 are received in the second cavity 34. This prevents the clip 50 from stressing the pair of electrical wires **20*a*, 20*b* entering the second cavity 34 intermediate the leg free ends 56 when the clip 50 and electrical wire pair 20** share the second cavity 34, as shown in FIGS. 1, 2 and 4.

As the fundamental purpose of the clip 50 is to share load between the various electrical wires and the lamp holder, the clip 50 is preferably configured and dimensioned such that the bight 54 extends laterally further than the legs 52, as illustrated in FIG. 6, so as to spread the point of contact between the various electrical wires and the bight to a greater degree.

As illustrated in FIG. 1, the various electrical wires —including the pair of electrical wires 20*a*, 20b associated with a lamp holder 14 and the plurality of electrical wires 20' , 22 associated with the other sets 12' —in combination support the lamp holder 14 (including the lamp 16 associated therewith). Preferably the housing 30 additionally includes means 68 for releasably securing the housing 30 to a support 70 (shown in phantom line in FIG. 4), which may be any structure capable of supporting or assisting in the support of the string 10. As illustrated, the securing means comprises an optionally resilient arm 68 extending generally parallel to the axis of housing 30 so that the supporting surface 70 may be trapped between the housing body 30 and the arm 68. Clearly a variety of other securing means may be used, depending upon the particular applications intended. In any case, the securing means 68 enables the housing 30 and hence the entire lamp holder 14 to be secured to and supported by the support 70 so that the lamp holder 14 can in turn support not only the pair of electrical wires 18, 20a, 20b, directly secured thereof, but also the plurality of other electrical wires passing through the bight 54 of clip 50.

Thus the clip 50 can serve the function of a mechanical reinforcement for the electrical wires in either of two opposite ways. Where the lamp holder 14 is not directly supported externally (for example, by means of the arm 68), the clip 50 supports the lamp holder by spreading its weight over the other electrical wires, thus alleviating the strain on the pair of wires 20*a*, 20*b* terminating in the lamp holder housing 30. On the other hand, where the lamp holder 14 is itself directly supported extremely (for example, by arm 68), the clip 50 in conjunction with housing 30 supports the other electrical wires passing through its bight 54 just as the lamp holder housing 14 itself directly supports the pair of wires 20*a*, 20*b* termininating therein.

It will further be appreciated that the clip serves the function of maintaining the various wires adjacent thereto in a neat, aesthetically acceptable package, while at the same time permitting the various wires passing therethrough to be separated from one another and from the lamp holder 14 for purposes of replacement or the like simply by removal of the clips from the lamp holders.

While the present invention has been described hereinabove in the context of a lamp holder, clearly the same principles apply to any appliance holder having a first cavity for receiving an electrical appliance, whether that electrical appliance happens to be a lamp or another type of electrical appliance to be energized by a pair of wires connected to the holder.

To summarize, the present invention provides an appliance holder (such as a lamp holder) in which the holder is supported by more than just the active wire, which provides support for the wires extending between the holders of another set intermediate their connections to the holders of the other set, or both.

Now that the preferred embodiments of the present invention have been shown and described in detail, various modifications and improvements thereon will become readily apparent to those skilled in the art. Accordingly, the appended claims are to be construed broadly and in a manner consistent with the spirit and scope of the invention described herein.

I claim:

1. In an appliance holder comprising an electrically insulative housing defining a first cavity for receiving an electrical appliance and a second cavity for receiving a pair of electrical wires, and electrically conductive contact means for operatively connecting the electrical appliance and the pair of wires;

the improvement comprising a generally U-shaped clip of electrically insulative resilient material defining a pair of legs and a bight connecting said legs, said bight and legs being configured and dimensioned to pass around a plurality of other electrical wires, and the free ends of said legs being received within and releasably engaging said second cavity of for integrating said clip, said appliance holder, the pair of wires, the other electrical wires, and the electrical appliance for movement as a unit.

2. The appliance holder of claim 1 wherein the pair of electrical wires and the plurality of other electrical wire in combination support said appliance holder.

3. The appliance holder of claim 1 for use with a support wherein said housing additionally includes means for releasably securing said housing to a support,-whereby when said housing is secured to and supported by the support it in turns supports the pair of electrical wires and the plurality of other electrical wires passing through said bight.

4. The appliance holder of claim 1 wherein said first and second cavities are disposed at opposite ends of said housing.

5. The appliance holder of claim 1 wherein said housing is generally cylindrical.

6. The appliance holder of claim 1 wherein said bight extends farther along the axis of the plurality of electrical wires than said legs.

7. The appliance holder of claim 1 wherein said bight biases said legs outwardly.

8. The appliance holder of claim 1 wherein the free end of each of said legs defines an outwardly projecting flange, and said second cavity defines a laterally opposed pair of surfaces adapted to receive said flanges when the free ends of said legs are received in said second cavity.

9. The appliance holder of claim 1 wherein said second cavity is of non-circular cross section to preclude relative rotation of said housing and said clip when said legs are received in said second cavity.

10. The appliance holder of claim 1 in combination with the electrical appliance, said electrical appliance being received within said first cavity.

11. The appliance holder of claim 10 wherein said appliance is a lamp.

12. The appliance holder of claim 11 wherein said electrical appliance comprises a lamp subassembly including a bulb and a bulb base having a pair of electrical contacts for energizing said bulb, and said contact means in said housing operatively connects the pair of electrical wires and said bulb base electrical contacts when said appliance holder receives said bulb base within said first cavity.

13. The appliance holder of claim 10 in combination with the pair of electrical wires, said pair of electrical wires terminating in said second cavity.

14. The appliance holder of claim 13 in combination with the plurality of other electrical wires partially disposed in said bight, each of said other electrical wires being connected to at least one like appliance holder.

15. The appliance holder of claim 14 in combination with a series of like appliance holders wherein one of said pair of electrical wires received in said second cavity of said appliance holder comprises one of the plurality of other electrical wires passing through the bight of one of said like appliance holders.

16. The appliance holder of claim 15 wherein said pair of electrical wires and said plurality of other electrical wires in combination support said appliance holder.

17. The appliance holder of claim 15 for use with a support wherein said housing additionally includes means for releasably securing said housing to a support, whereby when said housing is secured to and supported by the support it in turn supports said pair of electrical wires and siad plurality of other electrical wires passing through said bight.

18. In the combination of an appliance holder, a electrical appliance, a pair of electrical wires, and a plurality of other electrical wires connected to like appliance holders, said appliance holder comprising an electrically insulative housing defining a first cavity receiving said electrical appliance, a second cavity receiving said pair of electrical wires, and electrically conductive contact means for operatively connecting said electrical appliance and said pair of wires, the improvement comprising a generally U-shaped clip of electrically insulative resilient material defining a pair of legs and a bight connecting said legs, said bight and legs being configured and dimensioned to pass around said plurality of other electrical wires and biasing said legs outwardly, and said legs being received within and releasably engaging said second cavity for integrating said clip, said appliance holder, said pair of wires, said plurality of other electrical wires, and siad electrical appliance for movement as a unit, the free end of each of said legs defining an outwardly projecting flange, and said second cavity defining a laterally opposed pair of surfaces adapted to receive said flanges when the free ends of said legs are received in said second cavity, said housing additionally including means for releasably securing said housing to a support, whereby when said housing is secured to and supported by the support it in turn supports said pair of electrical wires and said plurality of other electrical wires passing through said bight, said second cavity being of non-circular cross section to preclude relative rotation of said housing and said clip when said legs are received in said second cavity.

19. The appliance holder of claim 18 in combination with a series of like appliance holders wherein at least one of said pair of electrical wires received in said second cavity of said appliance holder comprises one of the plurality of other electrical wires passing through the bight of one of said like appliance holders.

20. In an appliance holder comprising an electrically insulative housing defining a first cavity for receiving an electrical appliance and a second cavity for receiving a pair of electrical wires, and electrically conductive contact means for operatively connecting the electrical appliance and the pair of wires, the improvement comprising a generally U-shaped clip of electrically insulative resilient material defining a pair of legs and a bight connecting said legs, said bight and legs being configured and dimensioned to pass around a plurality of other electrical wires, said bight extending farther along the axis of the plurality of electrical wires than said legs, and the free ends of said legs being received within and releasably engaging said housing for integrating said clip, said appliance holder, the pair of wires, the other electrical wires, and the electrical appliance for movement as a unit.

* * * * *